US005752371A

United States Patent [19]

Mosley

[11] Patent Number: 5,752,371

[45] Date of Patent: May 19, 1998

[54] BAG LOADING DEVICE

[76] Inventor: Joel N. Mosley, 92-375 Waiomea, Kapolei, Hi. 96707

[21] Appl. No.: 745,994

[22] Filed: Nov. 8, 1996

[51] Int. Cl.[6] ..... B65B 43/26

[52] U.S. Cl. ..... 53/570; 53/202; 53/390; 53/392

[58] Field of Search ..... 53/570, 390, 392, 53/202; 141/114, 313, 314, 316, 247, 234

[56] References Cited

U.S. PATENT DOCUMENTS

| | | | |
|---|---|---|---|
| 798,019 | 8/1905 | Deuel . | |
| 2,691,476 | 10/1954 | Petrea | 141/114 |
| 3,112,777 | 12/1963 | Lohse | 141/316 |
| 3,215,173 | 11/1965 | Rutherford | 141/114 |
| 3,406,727 | 10/1968 | Rexus | 141/314 |
| 4,553,617 | 11/1985 | Tatematsu | 222/485 |
| 5,297,596 | 3/1994 | Anson | 141/340 |
| 5,417,261 | 5/1995 | Kanzler | 141/114 |
| 5,555,709 | 9/1996 | Savigny et al. | 53/570 |

*Primary Examiner*—James F. Coan
*Assistant Examiner*—Gene L. Kim
*Attorney, Agent, or Firm*—Michael R. McKenna

[57] ABSTRACT

A bag loading device for sorting and storing in bags various medicaments and the like having a plurality of independently pivotable elongated funnels arranged longitudinally in two parallel rows. The funnels can be positioned for easy placement of a collecting bag on the discharge end and pivoted to disposed the bag underneath the funnel and secure it for filling—all within a framed unit which allows for multiple bags simultaneously.

19 Claims, 3 Drawing Sheets

FIG. 3
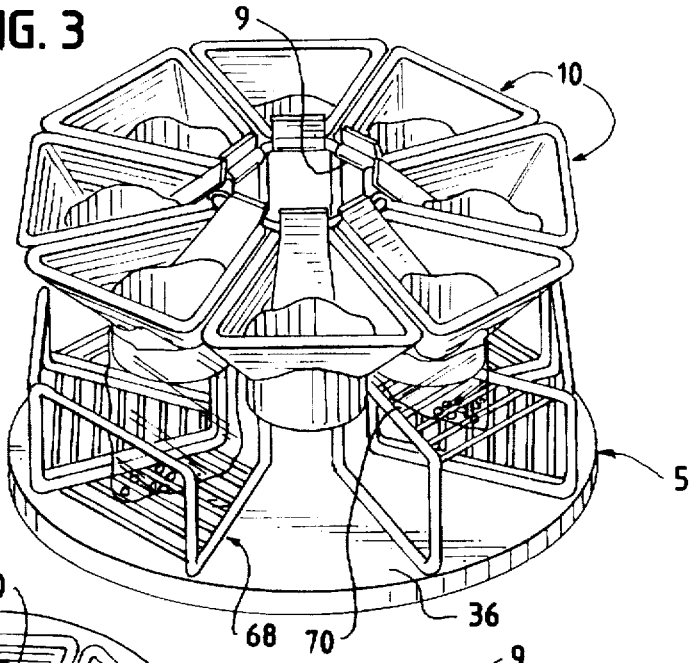
FIG. 4
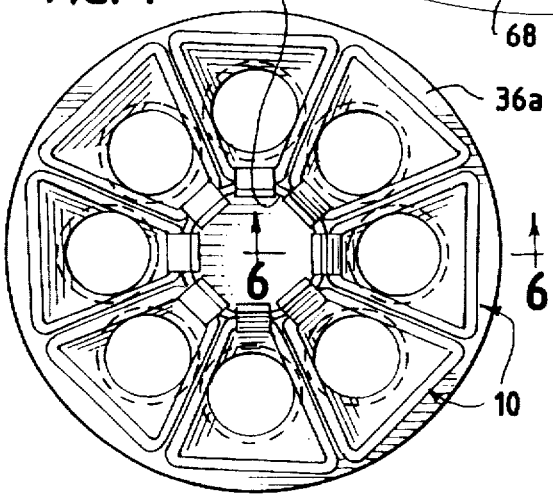
FIG. 6
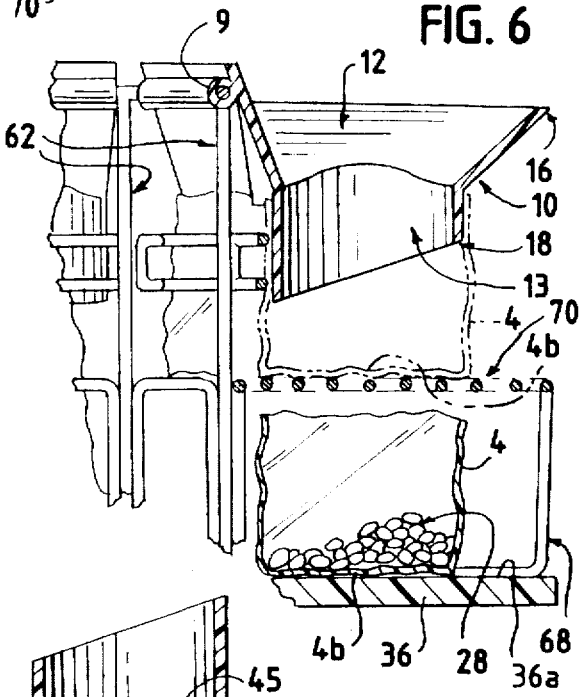
FIG. 5
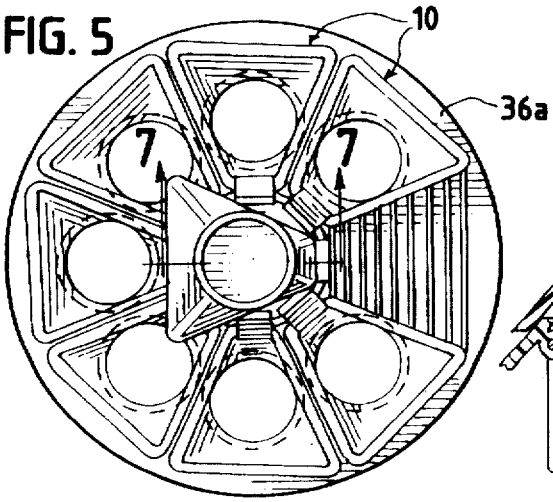
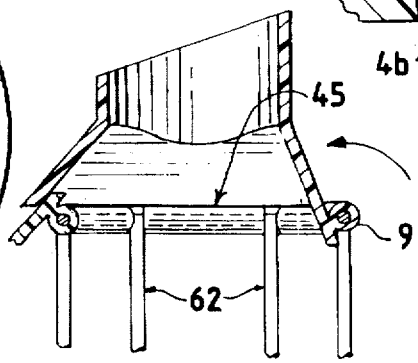
FIG. 7

FIG. 8
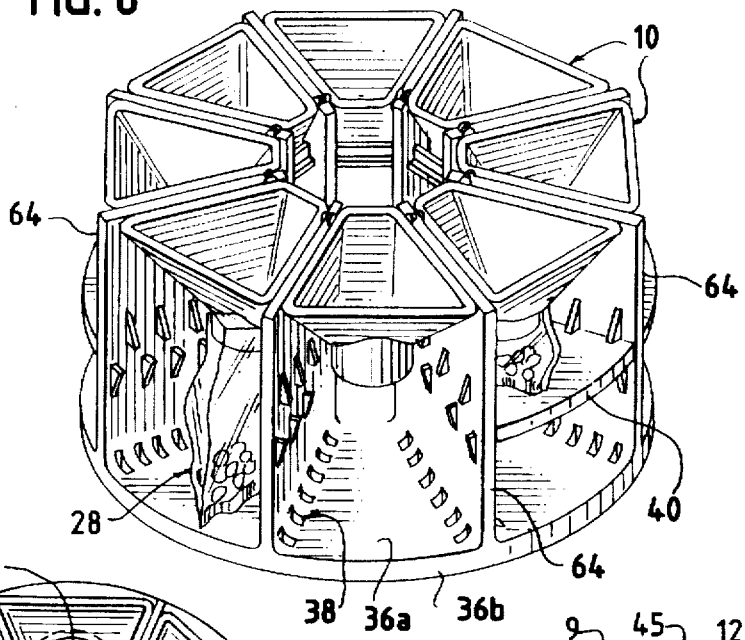
FIG. 9
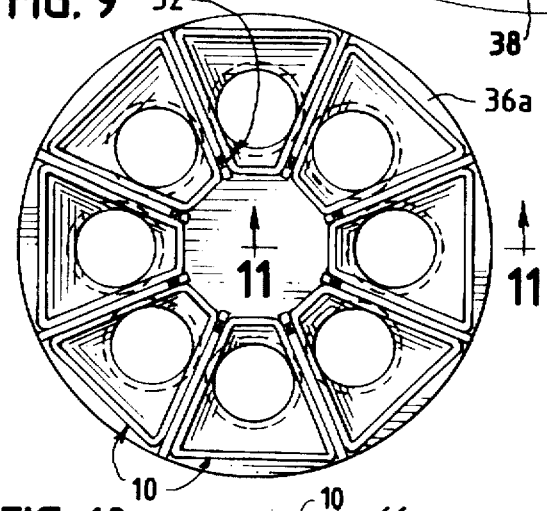
FIG. 11
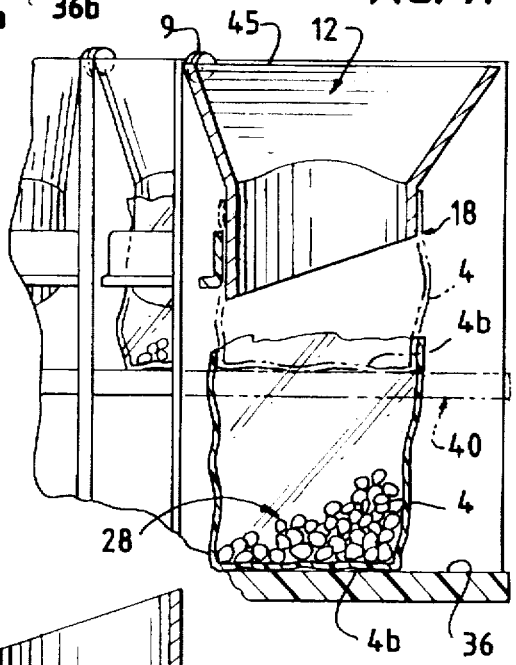
FIG. 10
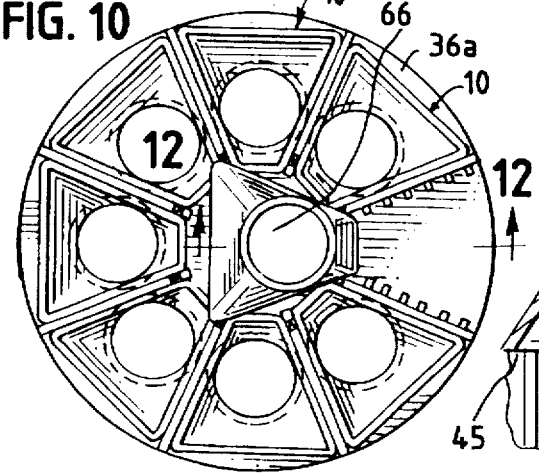
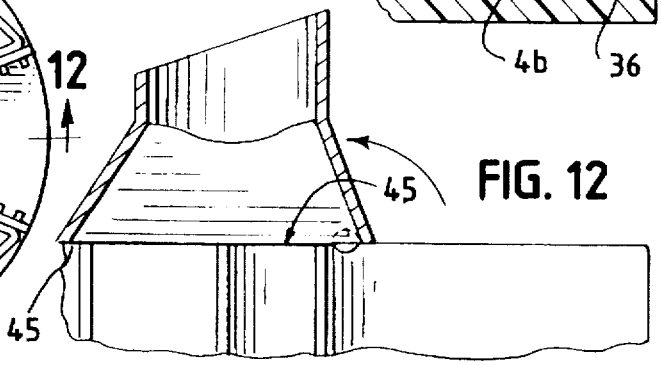
FIG. 12

BAG LOADING DEVICE

BACKGROUND OF THE INVENTION

This invention relates to a bag loading device, for use with a collecting bag, comprising at least one elongated funnel having a top opening for loading and a bottom opening for discharging into the collecting bag that is disposed in operative association with the discharge end of the funnel.

Additionally provided are means for pivotally supporting each of the at least one elongated funnel between a first position in which the bottom opening is disposed upwardly relative to the top opening, for ease in placing a bag on the discharge end, and a second position in which the top opening is disposed upwardly relative to the bottom opening for loading articles into the funnel and to load the bag.

Noting that there are seven days to a week, fourteen days in two weeks and twenty eight days in four weeks, a preferred embodiment of the instant invention, provides seven funnels disposed on one side to house a daily regiment of vitamins, medicaments, and other daily articles required to be sorted and packed by a weekly traveler. The invention could easily be adapted to have more or less funnels to fit a monthly or other regime.

When travelers prepare to go on a vacation, they may be required to take a number of vitamins and medications daily. To carry and pack all of the vitamins or medication containers without this device would be too cumbersome. Therefore, for a 14-day vacation, a traveler may make fourteen separate piles of daily requirements and then deposit them into a small bag or other container for traveling. This invention overcomes the hassle associated with trying to sort and pack all the pills into small bags.

This invention is directed at but not limited to everyday users of vitamins, herbs, minerals and/or medications. It allows the user at one sitting to make up a substantial quantity of bagged items, eliminating the daily ordeal of opening multiple containers for dispensing. The above process and procedure is a small chore in comparison to the benefits reaped. It allows an individual to tailor items to his or her own needs in a timely and fairly hassle free manner. It would be very hard for a company to supply the exact needs for each and every one of the consumers today in prepackaged form. With the prepackaged vitamins and minerals available now, you buy what is there. But sometimes, all needs or desires are not fulfilled. These type of packages are more costly than buying bulk. Purchasing bulk and tailoring end needs provides for a cost savings and allows the user to get what he or she actually wants.

Alternative technology is available in the form of U.S. Pat. No. 928,356 issued to Brown in 1909 for a capsule filler providing a base with capsule holder and a rotatable platform having tapered upper portions aligned with the respective capsule holder for loading powders into the capsules. The primary disadvantage of the Brown device is that the platform containing the tapered upper portions lends itself to mass distribution of minute product, such as powder, but does not conveniently provide for the breakdown and mixing of various medications, vitamins, pills, and other articles, into individual collecting bags that are easily engaged, positioned for filling, and disengaged from the instant bag loading device.

Another patent, U.S. Pat. No. 798,019, issued to Deuel in 1905, for a bag holder and shaker, reveals a rotatable funnel hingedly connected to a base that employs a distinct means for attaching the bag to the funnel. Unlike the present invention, Deuel requires that the bag opening be affixed to a discrete ring element. By comparison, the instant invention allows the opening of the bag to be easily slipped over the end of an extended funnel neck on the discharge end of the funnel which has been rotated about 180° so that the discharged end is pointed upwardly. Additionally, as the funnel is rotated back to a fill position, the neck of the funnel combines with a stationary cross bar to secure the bag in place. The fit is not so tight as to cause a struggle putting the bags on nor is to loose to allow them to fall off when rotating to the load position. Moreover, the bag is easily removed by merely pulling on the bag laterally, causing the funnel neck to rotate away from the cross bar, whereby, the bag is freed without the need to extract the bag from a ring element as is required in Deuel. See also U.S. Pat. No. 129,633 for an improvement in hoppers for bag holders.

Another patent, U.S. Pat. No. 4,122,651, issued to Braverman in 1979, reveals an apparatus and method for filling medicinal dispensing devices, but is structurally dissimilar to the present invention.

Commercial bag filling devices are disclosed in U.S. Pat. Nos. 4,526,214 and 5,297,596. Some of the drawbacks to these designs are that each teaches necessarily complex structures required for their commercial application, which are structurally unrelated to the instant invention.

To alleviate this problem, and others which will become apparent from the disclosure which follows, the present invention conveniently provides a uncomplicated manual system that allows for easy use with readily available plastic bags, preferably resealable plastic bags.

The citation of the foregoing publications is not an admission that any particular publication constitutes prior art, or that any publication alone or in conjunction with others, renders unpatentable any pending claim of the present application. None of the cited publications is believed to detract from the patentability of the claimed invention.

ADVANTAGES OF THIS INVENTION

Unlike the foregoing devices which teach structures that support commercial applications or involve manual dexterity to fashion a bag over a ring member, the important invention disclosed herein, allows for easy use with readily available plastic bags, preferably resealable plastic bags, which can be accessibly slipped over the top of an upwardly disposed discharge end of a pivotable funnel, allows for easy rotation of the funnel back to a fill position, securing the bag in place between the neck of the funnel and a stationary cross bar while articles are deposited in to the bag through the funnel, and allows the bag to be easily removed by merely pulling on the bag laterally, causing the funnel neck to rotate away from the cross bar, whereby, the bag is easily freed.

The invention is uncomplicated and thus its costs will be low. The rectangularly based embodiment will easily pack and store on the shelf in a home or a store. It is easy to operate. You flip one side up, put bags on, flip it back down and do the opposite side in the same manner, without needing to turn the unit around. Whatever is being packed can be placed without turning the base around. Once this has been accomplished, the bags can be removed, once again without turning the unit. If labelling is being used on the bags, turning the unit may facilitate labeling.

The invention disclosed herein works as a manual break down machine for bulk items, herbs and vitamins for an individual's daily use or for other small items such as those used in hobbies, crafts or trades—beads, nut, washers, fish hooks, seed, butt connectors and screws, just to name a few. Items that can be broken down for distribution in retail sales or in field applications where only a small portion of bulk items are needed. It utilizes an item readily available on the open market, the re-sealable plastic bag. It is designed to use the 2×2 or 2×3 inch bags. The use of the 2×2 bag requires a shortened base height. A removable cross bar provides the required support. The projected scope of the invention could be adapted to fit other bag sizes as well.

Still other advantages will be apparent from the disclosure that follows.

SUMMARY OF THE INVENTION

The invention relates to a bag loading device, for use with at least one collecting bag having a top entry and a sealed bottom, comprising a base member, at least one elongated funnel having a top opening for loading disposed at a proximate end and a bottom opening for discharging that is disposed at a distal end. The distal end has a transverse dimension measured in all directions that is less by a predetermined amount than the smallest transverse dimension of the top entry of the collecting bag.

Additionally provided are means for pivotally supporting each of the at least one elongated funnel between a first position in which the bottom opening is disposed upwardly relative to the top opening and a second position in which the top opening is disposed upwardly relative to the bottom opening.

The means for pivotally supporting the funnels are operably connected to the base member. In this way, the funnels may be disposed in the first position in which the bottom opening of the distal end is disposed upwardly relative to the top opening. Moreover, the top entry of the collecting bags may be operatively placed over the upwardly extending distal end of the funnels, and each of the funnels with its collecting bag on the distal end may be pivotally rotated from the first position to the second position, thereby positioning the funnels with the top opening upwardly disposed for loading of an article and with the bottom opening disposed downwardly for discharging the article into the collecting bag.

BRIEF DESCRIPTION OF THE DRAWINGS

Preferred embodiments of the invention are described hereinafter with reference to the accompanying drawing wherein:

FIG. 3 is a perspective view of a second preferred embodiment of the bag loading device of the present invention showing eight funnels supported by an octagonally shaped rod with one collecting bag supported on a top surface of a support shelf and another supported on the bottom surface of the support shelf (or alternatively on the bottom wall of the frame when the support shelf is removed).

FIG. 4 is a top elevation view of the bag loading device of FIG. 3.

FIG. 5 is a top elevation view of the bag loading device of FIG. 3 showing one of the funnels disposed in a first position in which the bottom opening is disposed upwardly relative to the top opening.

FIG. 6 is a fragmentary cross-section view taken along line 6—6 of FIG. 4 showing one of the elongated funnels in a second position in which the top opening is disposed upwardly relative to the bottom opening with an elongated collecting bag supported by the bottom surface of the frame and a shorter collecting bag supported by the support bar shown in phantom.

FIG. 7 is a fragmentary cross-sectional view taken along line 7—7 of FIG. 5 showing the funnel in a first position in which the bottom opening is disposed upwardly relative to the top opening and the rim of the top opening is supported on an upward edge of the vertical wall.

FIG. 8 is a perspective view of a third preferred embodiment of the bag loading device of the present invention showing eight funnels, each supported by two pivot pins, each fastened to a side of the funnel and an interpolative vertical wall extending upwardly from the bottom wall of the frame and with one collecting bag supported on a support bar and another supported on the bottom wall of the frame.

FIG. 9 is a top elevation view of the bag loading device of FIG. 8.

FIG. 10 is a top elevation view of the bag loading device of FIG. 8 showing one of the funnels disposed in a first position in which the bottom opening is disposed upwardly relative to the top opening.

FIG. 11 is a fragmentary cross-section view taken along line 11—11 of FIG. 9 showing one of the elongated funnels in a second position in which the top opening is disposed upwardly relative to the bottom opening with an elongated collecting bag supported by the bottom surface of the frame and a shorter collecting bag supported by the support bar shown in phantom.

FIG. 12 is a fragmentary cross-sectional view taken along line 12—12 of FIG. 10 showing the funnel in a first position in which the bottom opening is disposed upwardly relative to the top opening and the rim of the top opening is supported on an upward edge of the vertical wall.

DETAILED DESCRIPTION OF THE INVENTION

Figure 1:
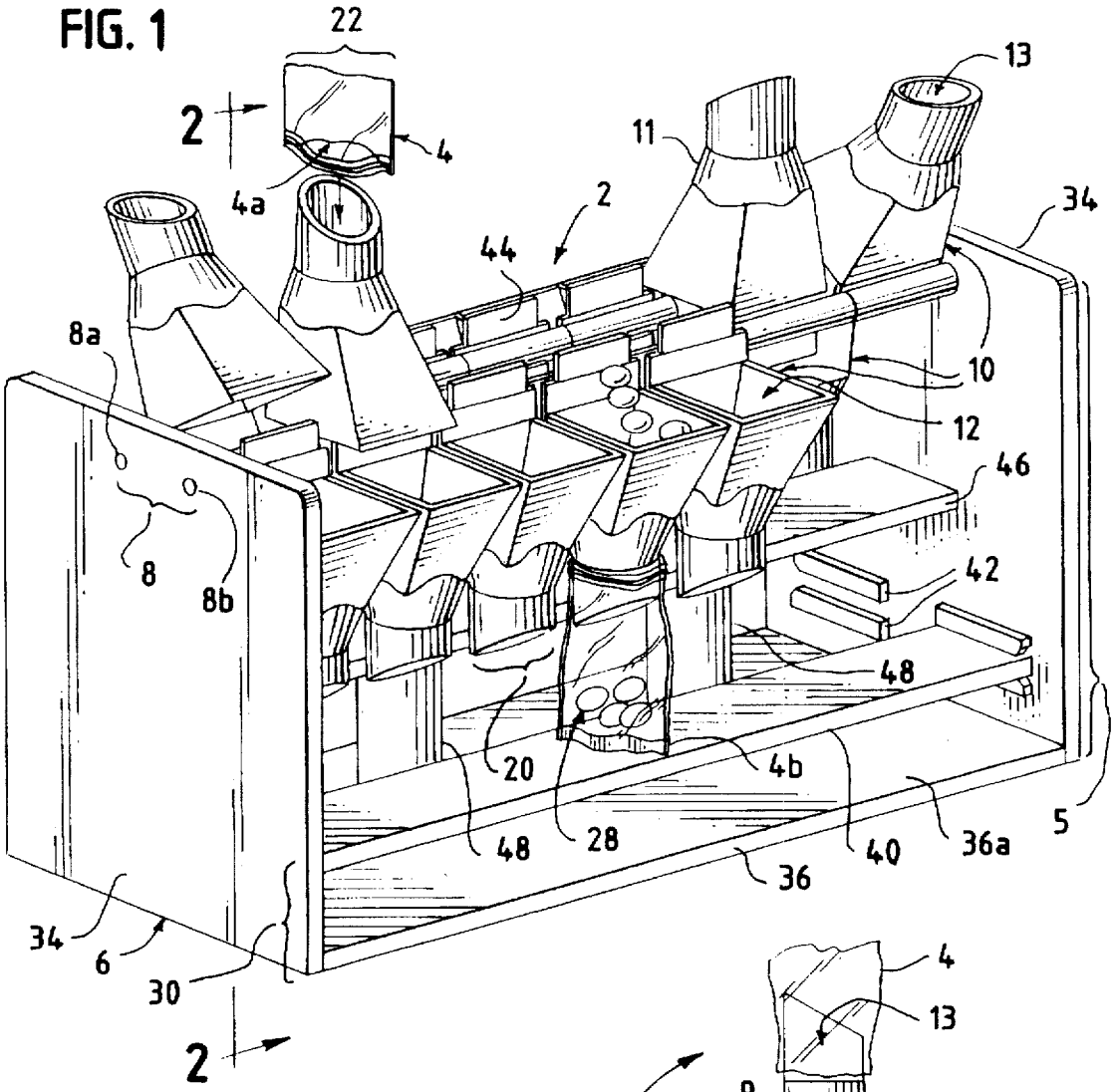
FIG. 1 is a perspective view of a first preferred embodiment of the bag loading device of the present invention showing the pivotal placement of some of the plurality of funnels which may be rotated between a first position in which the bottom opening is disposed upwardly relative to the top opening to receive a collecting bag and a second position in which the top opening is disposed upwardly relative to the bottom opening when the top opening can receive a variety of articles which may be funneled into a bag associated with the funnel and in which the bag is supported by a support bar.

The preferred embodiments depicted in the drawing include a bag loading device 2, for use with a up to ten collecting bags 4 at a time, each bag having a top entry 4*a* and a sealed bottom 4*b*, comprising a base member 5, ten elongated funnels 10, each of which has a top opening 12 for loading disposed at a proximate end 16 and a bottom opening 13 for discharging disposed at a distal end 18. The distal end 18 has a transverse dimension 20 measured in all directions that is less by a predetermined amount than the smallest transverse dimension 22 of the top entry 4*a* of one of the plurality of collecting bags 4.

Without departing from the generality of the invention disclosed herein, the support rods 8 could be lengthened to accommodate a greater maximum number of funnels 10 or made shorter to accommodate a lesser maximum number.

The discussion that follows, without limiting the scope of the invention, will refer to the invention as depicted in the drawing, showing an apparatus that will accommodate ten funnels in the parallel rod configuration and eight funnels in the octagonal configuration.

Figure 2:
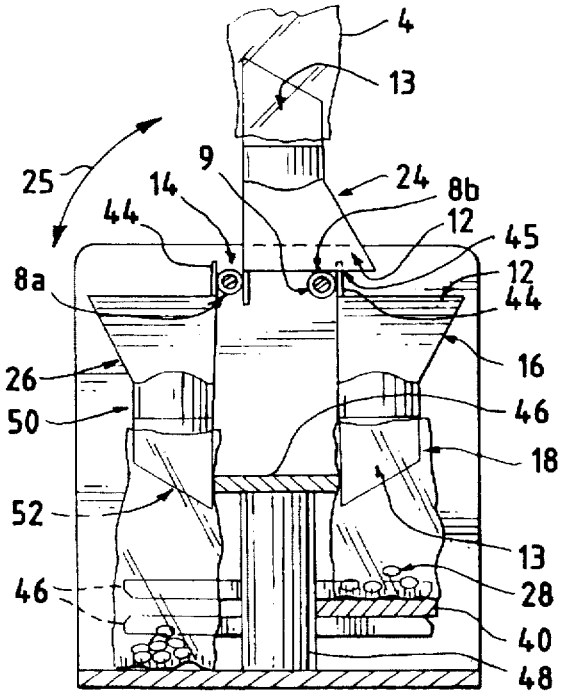
FIG. 2 is a side elevation view taken along the line 2—2 of FIG. 1 showing one of a plurality of funnels in a first position in which the bottom opening is disposed upwardly relative to the top opening for receiving a collecting bag with the rim of the top opening resting on an upwardly extending lip of the longitudinally corresponding funnel supported by another rod and showing two funnels in a second position in which the top opening is disposed upwardly relative to the bottom opening each having a collecting bag—one of which is supported on a support bar and the other which is supported on the bottom wall of the frame.

The preferred embodiments of the apparatus depicted in the drawing comprise a bag loading device 2, for use with at least one collecting bag 4 having a top entry 4*a* and a sealed bottom 4*b*, comprising a base member 5, at least one elongated funnel 10 having a top opening 12 for loading disposed at a proximate end 16 and a bottom opening 13 for discharging disposed at a distal end 18, the distal end having a transverse dimension 20 measured in all directions that is less by a predetermined amount than the smallest transverse dimension 22 of the top entry 4*a* of the collecting bag 4, and means for pivotally supporting 14 each of the at least one elongated funnel 10 between a first position 24 in which the bottom opening 13 is disposed upwardly relative to the top opening 12 and a second position 26 in which the top opening 12 is disposed upwardly relative to the bottom opening 13, as best shown in FIG. 2.

The means for pivotally supporting 14 the at least one elongated funnel 10 is operably connected to the base member 5. Whereby, the at least one elongated funnel may be disposed in the first position 24 in which the bottom opening of the distal end is disposed upwardly relative to the top opening. Moreover, the top entry 4*a* of the at least one collecting bag 4 may be operatively placed over the upwardly extending distal end 18 of the at least one funnel 10, and the at least one funnel with the collecting bag on the distal end may be pivotally rotated from the first position 24 to the second position 26, thereby positioning the at least one elongated funnel with the top opening 12 upwardly disposed for loading of an article 28 and with the bottom opening 13 of the at least one elongated funnel 10 disposed downwardly for discharging the article 28 into the collecting bag 4.

In a preferred embodiment of the invention, as shown in FIG. 1, a bag loading device 2, for use with at least one collecting bag 4 having a top entry 4*a* and a sealed bottom 4*b*, comprises a base member 5, at least one elongated funnel 10 having a top opening 12 for loading disposed at a proximate end 16 and a bottom opening 13 for discharging disposed at a distal end 18, the distal end 18 having a transverse dimension 20 measured in all directions that is less by a predetermined amount than the smallest transverse dimension 22 of the top entry 4*a* of the collecting bag 4. Furthermore, means for pivotally supporting 14 each of the at least one elongated funnel 10 between a first position 24 in which the bottom opening 13 is disposed upwardly relative to the top opening 12 and a second position 26 in which the top opening 12 is disposed upwardly relative to the bottom opening 13.

In such preferred embodiment, the means for pivotally supporting 14 the at least one elongated funnel 10 is operably connected to the base member 5. Whereby, the top entry 4*a* of the at least one collecting bag 4 may be operatively placed over the upwardly extending distal end 18 of the at least one funnel 10. Additionally, means for carrying 30 the sealed bottom 4*b* of the at least one collecting bag 4 which is in operative association with the downwardly disposed bottom opening 13 of the at least one elongated funnel 10 that is disposed in the second position 26 are provided. The means for carrying 30 are attached to and supported by the base member 5.

Thus, the at least one elongated funnel 10 may be disposed in the first position 24 in which the bottom opening 13 of the distal end 18 is disposed upwardly relative to the top opening 12, the top entry 4*a* of the at least one collecting bag 4 may be placed over the upwardly extending distal end 18 of the at least one funnel 10, and the at least one funnel with the collecting bag on the distal end may be pivotally rotated from the first position to the second position 26, thereby positioning the at least one elongated funnel 10 with the top opening 12 upwardly disposed for loading of an article 28 and with the bottom opening 13 of the at least one elongated funnel 10 disposed downwardly for discharging the article into the collecting bag 4 which is supported by the means for carrying 30.

Included also are means for pivotally supporting 14 each of the plurality of elongated funnels 10 between a first position 24 in which the bottom opening 13 is disposed upwardly relative to the top opening 12 and a second position 26 in which the top opening 12 is disposed upwardly relative to the bottom opening 13.

The means for pivotally supporting 14 each of the plurality of elongated funnels 10 is operably connected to the base member 5. Whereby, the top entry 4*a* of each of the plurality of collecting bags 4 may be operatively placed over the upwardly extending distal end 18 of one of the plurality of funnels 10, and means for carrying 30 the sealed bottom 4*b* of each of the plurality of collecting bags 4 which is in operative association with the downwardly disposed bottom opening 13 of one of the plurality of elongated funnels 10 that is disposed in the second position 26. The means for carrying 30 being further attached to and supported by the base member 5, whereby, each of the plurality of elongated funnels 10 may be disposed in the first position 24 in which the bottom opening 13 of the distal end 18 is disposed upwardly relative to the top opening 12; the top entry 4*a* of each of the plurality of collecting bags 4 may be placed over the upwardly extending distal end 18 of one of the plurality of funnels 10; and each of the plurality of funnels 10 with one of the collecting bags 4 on the distal end 18 may be pivotally rotated from the first position 24 to the second position 26, as shown in FIG. 2, thereby positioning each of the plurality of elongated funnels 10 with the top opening 12 upwardly disposed for loading of an article 28 and with the bottom opening 13 disposed downwardly for discharging the article 28 into the collecting bag 4 which is supported by the means for carrying 30.

In a preferred embodiment of the invention described above, each of the at least one elongated funnel may be independently pivotable. The funnel's independent swivel action allows removal of the bags and their contents one at a time, not disturbing the other bag units.

Moreover, the included rotational angle 25 between the first position 24 and the second position 26 is in the range of approximately 90 to 180 degrees. Preferably, the included rotational angle 25 between the first position 24 and the second position 26 is approximately 180 degrees.

In a preferred embodiment of the invention, as shown in FIGS. 1 and 2, the at least one elongated funnel 10 comprises a plurality of elongated funnels arranged side by side in at least one row, and the means for pivotally supporting 14 each of the at least one elongated funnel 10 comprises an elongated horizontal rod 8 supported at each end by the base member which rod is operatively connected to an elongated horizontal eyelet 9 of each of the plurality of elongated funnels 10.

In a preferred embodiment of the invention, as shown in FIGS. 1 and 2, the means for pivotally supporting each of the at least one elongated funnel comprises a first horizontal rod 8*a* and a second horizontal rod 8*b*. Each of said horizontal rods 8 having rod ends that are supported by the base member 5.

The first horizontal rod 8*a* is parallel to the second horizontal rod 8*b*, and the at least one elongated funnel 10 comprises a first plurality of elongated funnels arranged side by side longitudinally in a first row along the first horizontal rod 8*a* and a second plurality of elongated funnels, equal in number and pattern of longitudinal distribution to the first plurality of elongated funnels, arranged side by side in a second row along the second horizontal rod 8*b*.

Each horizontal rod is operatively connected to an elongated horizontal eyelet 9 of each of the adjacent plurality of elongated funnels 10. Moreover, each of the elongated funnels has a stabilizing lip 44 extending beyond the top opening 12 from the proximate end thereof. In the preferred embodiment of the invention shown in FIG. 2, the first plurality of elongated funnels is arranged so that the stabilizing lip 44 of each funnel 10 disposed in the second position 26 supports a portion of the upper rim 45 of the top opening 12 of one of the second plurality of elongated funnels that is disposed in a first position 24 along a corresponding portion of the second rod 8*b*, and the second plurality of elongated funnels being arranged so that the stabilizing lip 44 of each funnel disposed in the second position 26 supports a portion of the upper rim 45 of the top opening 12 of one of the first plurality of elongated funnels that is disposed in a first position 24 along a corresponding portion of the second rod 8*b*.

To facilitate placement of the funnels in a side by side relationship, the wider proximate end 16 of the funnel 10 has a horizontal cross-section shaped like a rectangle, as shown in FIG. 1.

As best shown in FIG. 1, the base member 5 comprises a frame 6 having a rectangularly shaped bottom wall 36, two generally vertical side walls 34, each side wall having its lower edge connected to an opposing side edge of the bottom wall 36, and a cross bar 46 extending from and attached to each of the vertical side walls 34 with medial support from at least one vertical post 48 extending upwardly from the bottom wall 36. The cross bar 46 is suitably sized and adapted to restrict the pivoting movement of the at least one elongated funnel 10 and to engage a collecting bag 4 disposed on the distal end 18 of the at least one elongated funnel 10, as shown in FIG. 2.

Additionally, the bag loading device 2 of this important invention may further comprise means for carrying 30 the sealed bottom 4*b* of a collecting bag 4. One embodiment of such means is the upper surface 36*a* of the bottom wall 36 of the base member 5. Alternatively, at least one support bar 40 extending from and attached to each of the vertical side walls 34 of the base member may provide such support.

Such support bar 40 is suitably sized and adapted to support the sealed bottom 4*b* of each of the at least one collecting bag 4 which is in operative association with the downwardly disposed bottom opening 13 of one of the plurality of elongated funnels 10 that is disposed in the second position 26.

In preferred embodiment of the invention, as shown in FIGS. 2, 6 and 11, the distal end 18 of the at least one elongated funnel 10 has an extended neck 50 with an oblique end cut for ready insertion in to the top entry 4*a* of the collecting bag 4.

In a preferred embodiment of the invention, as shown in FIG. 1, a bag loading device, for use with at least one collecting bag having a top entry and a sealed bottom, comprises a base member 5 having a frame with a bottom wall 36 that is rectangularly shaped, two generally vertical side walls 34, each side wall having its lower edge connected to an opposing side edge of the bottom wall 36, and a cross bar 46 extending from and attached to each of the vertical side walls 36 and having medial support from at least one vertical post 48 extending upwardly from the bottom wall 36.

The cross bar 46 is suitably sized and adapted to restrict the pivoting movement of the at least one elongated funnel 10 and to engage a collecting bag 4 disposed on the distal end 18 of the at least one elongated funnel 10.

Also provided are means for pivotally supporting 14 each of the at least one elongated funnel 10 between a first position 24 in which the bottom opening 13 is disposed upwardly relative to the top opening 12 and a second position 26 in which the top opening 12 is disposed upwardly relative to the bottom opening 13, and wherein the included rotational angle 25 between the first position 24 and the second position 26 is approximately 180 degrees.

Means for pivotally supporting 14 the at least one elongated funnel 10 are supplied that are operably connected to the base member 5, whereby, the top entry 4*a* of the at least one collecting bag 4 may be operatively placed over the upwardly extending distal end 18 of the at least one funnel 10.

As shown in FIGS. 1 and 2, the means for pivotally supporting 14 each of the at least one elongated funnel 10 comprises a first horizontal rod 8*a* and a second horizontal rod 8*b*. The first horizontal rod 8*a* is parallel to the second horizontal rod 8*b*. As best shown in FIG. 1, the at least one elongated funnel 10 has a top opening 12 for loading disposed at a proximate end 16 and a bottom opening 13 for discharging disposed at a distal end 18, wherein the cross-section of the proximate end 16 of one of the at least one elongated funnel 10 disposed in the second position 26 taken in a horizontal plane forms a rectangle.

Moreover, the at least one elongated funnel 10 comprises a first plurality of elongated funnels arranged side by side longitudinally in a first row along the first horizontal rod 8*a* and a second plurality of elongated funnels, equal in number and pattern of longitudinal distribution to the first plurality of elongated funnels, arranged side by side in a second row along the second horizontal rod 8*b*.

Each horizontal rod 8 is operatively connected to an elongated horizontal eyelet 9 of each of the adjacent plurality of elongated funnels 10, as shown in FIG. 2. Each of the elongated funnels further has a stabilizing lip 44 extending beyond the top opening 12 from the proximate end 16 thereof.

The first plurality of elongated funnels is arranged so that the stabilizing lip 44 of each funnel 10 disposed in the second position 26 supports a portion of the upper rim 45 of the top opening 12 of one of the second plurality of elongated funnels that is disposed in a first position 24 along a corresponding portion of the second rod 8*b*. Conversely, the second plurality of elongated funnels is arranged so that the stabilizing lip 44 of each funnel 10 disposed in the second position 26 supports a portion of the upper rim 45 of the top opening 12 of one of the first plurality of elongated funnels that is disposed in a first position 24 along a corresponding portion of the first rod 8*a*.

The distal end 18 of the funnel 10 has a transverse dimension 20 measured in all directions that is less by a predetermined amount than the smallest transverse dimension 22 of the top entry 4*a* of the collecting bag 4. And each of the at least one elongated funnel 10 is independently pivotable.

In addition, means for carrying 30 the sealed bottom 4*b* of the at least one collecting bag 4 which is in operative association with the downwardly disposed bottom opening 13 of the at least one elongated funnel 10 that is disposed in the second position 26 is provided. The means for carrying 30 is attached to and supported by the base member 5.

Whereby, the at least one elongated funnel 10 may be disposed in the first position 24 in which the bottom opening 13 of the distal end 18 is disposed upwardly relative to the top opening 12; the top entry 4*a* of the at least one collecting bag 4 may be placed over the upwardly extending distal end 18 of the at least one funnel 10; and the at least one funnel with the collecting bag on the distal end may be pivotally rotated from the first position 24 to the second position 26, thereby positioning the at least one elongated funnel 10 with the top opening 4*a* upwardly disposed for loading of an article 28 and with the bottom opening 4*b* of the at least one elongated funnel 10 disposed downwardly for discharging the article 28 into the collecting bag 4 which is supported by the means for carrying 30.

In a further refinement to the above embodiment of the instant invention, the means for carrying 30 may comprise an upper surface 36*a* of the bottom wall 36 of the base member 5 or at least one variable height support bar 40 extending from and attached to each of the vertical side walls 34 of the base member 5. The support bar 40 is suitably sized and adapted to support the sealed bottom 4*b* of each of the at least one collecting bag 4 which is in operative association with the downwardly disposed bottom opening 13 of one of the plurality of elongated funnels 10 that is disposed in the second position 26. The support bar 10 may be sufficiently wide to support the bags 4 engaged to the funnels of both rods (8*a* and 8*b*), or, as shown in the drawing, two support bars (8*a* and 8*b*, respectively) may be employed—each support bar 8 in operative engagement with the bags of a particular row of funnels 10, as shown in FIG. 1.

Furthermore, the distal end 18 of the at least one elongated funnel 10 may have an extended neck 50 with an oblique end cut 52 for easy insertion in to the top entry 4*a* of the collecting bag 4.

In another preferred embodiment of the invention, as shown in FIG. 3, the bag loading device of the instant invention is octagonally configured. The frame has a circularly shaped bottom wall 36*b*. As best shown in FIGS. 3–5, the means for pivotally supporting each of the at least one elongated funnel comprises a generally horizontal octagonally shaped rod 60 supported by a plurality of vertical members 62 extending from the rod 60 to the circularly shaped bottom wall 36*b* of the base member 5. The at least one elongated funnel comprises eight elongated funnels 10 arranged with each funnel pivotally supported by one side of the generally horizontal octagonally shaped rod 60.

The generally horizontal octagonally shaped rod 60 is operatively connected to an elongated horizontal eyelet 9 attached to each of the adjacent plurality of elongated funnels 10. Each of the elongated funnels 10 has an upper rim 45 of the top opening 12 from the proximate end 16 thereof, and each of the elongated funnels 10 is arranged so that the upper rim 45 of the top opening 12 of at least one of the funnels 10 disposed in the second position 26 supports a portion of the upper rim 45 of the top opening 12 of the elongated funnel 10 that is disposed in a first position 24 along an opposite segment of the generally horizontal octagonally shaped rod 60. Additionally, the cross-section of the proximate end 16 of one of the at least one elongated funnel 10 taken in a horizontal plane forms an isosceles trapezoid.

In a third preferred embodiment of the bag loading device 2 of the instant invention, the base member 5 comprises a frame 6 having an octagonally or circularly shaped bottom wall 36 and a plurality of vertical radially extending walls 64 extending upwardly from the bottom wall 36 of the frame 6 which vertical walls 64 are radially disposed relative to an axis passing through the center 66 of and perpendicular to the bottom wall 36, the plurality of elongated funnels 10 comprises eight elongated funnels 10, each funnel being interpolatively disposed between a pair of the plurality of vertical radially extending walls 64, means for pivotally supporting each of the elongated funnels between a first position 24 in which the bottom opening 13 is disposed upwardly relative to the top opening 12 and a second position 26 in which the top opening 12 is disposed upwardly relative to the bottom opening 13 comprises a first pivot pin 32*a* and a second pivot pin 32*b*, each of said first and second pivot pins fastens the funnel to one of the pair of adjacent vertical radially extending walls 64.

Each of the elongated funnels 10 has a top opening 12 for loading disposed at a proximate end 16 and a bottom opening 13 for discharging disposed at a distal end 18. Said distal end having a transverse dimension 20 measured in all directions that is less by a predetermined amount than the smallest transverse dimension 22 of the top entry 4*a* of the collecting bag 4.

Means for carrying 30 the sealed bottom 4*b* of said at least one collecting bag 4 which is in operative association with the downwardly disposed bottom opening 13 of the at least one elongated funnel 10 that is disposed in the second position 26 may also be provided. Moreover, the bottom 4*b* of the collecting bag may be supported by one of the bottom wall 36 of the frame and a top surface 70 of a support shelf 68 when said collecting bag 4 is disposed on one of the elongated funnels 10 in a second position 26 in which the top opening 12 is disposed upwardly relative to the bottom opening 13.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

While this invention has been described in connection with the best mode presently contemplated by the inventor for carrying out his invention, the preferred embodiments described and shown are for purposes of illustration only, and are not to be construed as constituting any limitations of the invention. Modifications will be obvious to those skilled in the art, and all modifications that do not depart from the spirit of the invention are intended to be included within the scope of the appended claims.

The invention resides not in any one of these features per se, but rather in the particular combination of all of them herein disclosed and claimed and it is distinguished from the prior art in this particular combination of all of its structures for the function specified.

Further, the purpose of the foregoing abstract is to enable the U.S. Patent and Trademark Office and the public generally, and especially the scientist, engineers and practitioners in the are who are not familiar with patent or legal terms of phraseology, to determine quickly from a cursory inspection the nature and essence of the technical disclosure of the application. The abstract is neither intended to define the invention of the application, which is measured by the claims, nor is it intended to be limiting as to the scope of the invention in any way.

These together with other objects of the invention, along with the various features of novelty which characterize the invention are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is a follows:

1. A bag loading device, for use with at least one collecting bag having a top entry and a sealed bottom, comprising:

a. at least one elongated funnel having a top opening for loading disposed at a proximate end and a bottom opening for discharging disposed at a distal end, said distal end having a transverse dimension measured in all directions that is less by a predetermined amount than the smallest transverse dimension of the top entry of the collecting bag;

b. a base member having a cross bar adapted to restrict the pivoting movement of the at least one elongated funnel and to engage the collecting bag disposed on the distal end of the at least one elongated funnel; and c. means for pivotally supporting each of said at least one elongated funnel between a first position in which the bottom opening is disposed upwardly relative to the top opening and a second position in which the top opening is disposed upwardly relative to the bottom opening, said means for pivotally supporting said at least one elongated funnel being operably connected to said base member;

whereby:

the at least one elongated funnel may be disposed in the first position in which the bottom opening of the distal end is disposed upwardly relative to the top opening, the top entry of the at least one collecting bag may be operatively placed over the upwardly extending distal end of the at least one funnel, and the at least one funnel with the collecting bag on the distal end may be pivotally rotated from the first position to the second position, thereby positioning the at least one elongated funnel with the top opening upwardly disposed for loading of an article and with the bottom opening of the at least one elongated funnel disposed downwardly for discharging said article into the collecting bag.

2. A bag loading device, for use with at least one collecting bag having a top entry and a sealed bottom, comprising:

a. at least one elongated funnel having a top opening for loading disposed at a proximate end and a bottom opening for discharging disposed at a distal end, said distal end having a transverse dimension measured in all directions that is less by a predetermined amount than the smallest transverse dimension of the top entry of the collecting bag;

b. a base member having a cross bar adapted to restrict the pivoting movement of the at least one elongated funnel and to engage the collecting bag disposed on the distal end of the at least one elongated funnel;

c. means for pivotally supporting each of said at least one elongated funnel between a first position in which the bottom opening is disposed upwardly relative to the top opening and a second position in which the top opening is disposed upwardly relative to the bottom opening, said means for pivotally supporting said at least one elongated funnel being operably connected to said base member, whereby, the top entry of the at least one collecting bag may be operatively placed over the upwardly extending distal end of the at least one funnel; and d. means for carrying the sealed bottom of said at least one collecting bag which is in operative association with the downwardly disposed bottom opening of the at least one elongated funnel that is disposed in the second position, said means for carrying being further attached to and supported by said base member;

whereby:

the at least one elongated funnel may be disposed in the first position in which the bottom opening of the distal end is disposed upwardly relative to the top opening, the top entry of the at least one collecting bag may be placed over the upwardly extending distal end of the at least one funnel, and the at least one funnel with the collecting bag on the distal end may be pivotally rotated from the first position to the second position, thereby positioning the at least one elongated funnel with the top opening upwardly disposed for loading of an article and with the bottom opening of the at least one elongated funnel disposed downwardly for discharging said article into the collecting bag which is supported by the means for carrying.

3. A bag loading device, for use with a plurality of collecting bags each having a top entry and a sealed bottom, comprising:

a. a plurality of elongated funnels equal in number to the number of said plurality of collecting bags each of said plurality of elongated funnels having a top opening for loading disposed at a proximate end and a bottom opening for discharging disposed at a distal end, said distal end having a transverse dimension measured in all directions that is less by a predetermined amount than the smallest transverse dimension of the top entry of one of the plurality of collecting bags;

b. a base member having a cross bar adapted to restrict the pivoting movement of the at least one elongated funnel and to engage the collecting bag disposed on the distal end of the at least one elongated funnel;

c. means for pivotally supporting each of said plurality of elongated funnels between a first position in which the bottom opening is disposed upwardly relative to the top opening and a second position in which the top opening is disposed upwardly relative to the bottom opening, said means for pivotally supporting each of said plurality of elongated funnels being operably connected to said base member, whereby, the top entry of each of the plurality of collecting bags may be operatively placed over the upwardly extending distal end of one of the plurality of funnels; and d. means for carrying the sealed bottom of each of said plurality of collecting bags which is in operative association with the downwardly disposed bottom opening of one of the plurality of elongated funnels that is disposed in the second position, said means for carrying being further attached to and supported by said base member;

whereby:

the each of the plurality of elongated funnels may be disposed in the first position in which the bottom opening of the distal end is disposed upwardly relative to the top opening, the top entry of each of the plurality of collecting bags may be placed over the upwardly extending distal end of one of the plurality of funnels, and each of the plurality of funnels with one of the collecting bags on the distal end may be pivotally rotated from the first position to the second position, thereby positioning each of the plurality of elongated funnels with the top opening upwardly disposed for loading of an article and with the bottom opening disposed downwardly for discharging said article into the collecting bag which is supported by the means for carrying.

4. The bag loading device of claim 1, wherein each of the at least one elongated funnel is independently pivotable.

5. The bag loading device of claim 1, wherein the included rotational angle between the first position and the second position is in the range of approximately 90 to 180 degrees.

6. The bag loading device of claim 5, wherein the included rotational angle between the first position and the second position is approximately 180 degrees.

7. The bag loading device of claim 1, wherein the at least one elongated funnel comprises a plurality of elongated funnels arranged side by side in a row, and the means for pivotally supporting each of said at least one elongated funnel comprises an elongated horizontal rod supported at each end by the base member which rod is operatively connected to an elongated horizontal eyelet of each of the plurality of elongated funnels.

8. The bag loading device of claim 1, wherein:

a. the means for pivotally supporting each of said at least one elongated funnel comprises a first horizontal rod and a second horizontal rod, the first horizontal rod being parallel to the second horizontal rod;

b. the at least one elongated funnel comprises a first plurality of elongated funnels arranged side by side longitudinally in a first row along the first horizontal rod and a second plurality of elongated funnels, equal in number and pattern of longitudinal distribution to the first plurality of elongated funnels, arranged side by side in a second row along the second horizontal rod, each horizontal rod being operatively connected to an elongated horizontal eyelet of each of the adjacent plurality of elongated funnels, each of said elongated funnels having a stabilizing lip extending beyond the top opening from the proximate end thereof, the first plurality of elongated funnels being arranged so that the stabilizing lip of each funnel disposed in the second position supports a portion of the upper rim of the top opening of one of the second plurality of elongated funnels that is disposed in a first position along a corresponding portion of the second rod, and the second plurality of elongated funnels being arranged so that the stabilizing lip of each funnel disposed in the second position supports a portion of the upper rim of the top opening of one of the first plurality of elongated funnels that is disposed in a first position along a corresponding portion of the second rod.

9. The bag loading device of claim 1, wherein the cross-section of the proximate end of one of the at least one elongated funnel disposed in the second position taken in a horizontal plane forms a rectangle.

10. The bag loading device of claim 1, wherein the base member comprises:

a. a frame having a rectangularly shaped bottom wall; and b. two generally vertical side walls, each side wall having its lower edge connected to an opposing side edge of the bottom wall; and wherein the cross bar extends from and attaches to each of the vertical side walls and has medial support from at least one vertical post extending upwardly from the bottom wall.

11. The bag loading device of claim 10, further comprising a means for carrying the sealed bottom of each of said at least one collecting bag which is in operative association with the downwardly disposed bottom opening of one of the at least one elongated funnel that is disposed in the second position having one of an upper surface of the bottom wall of the base member and at least one support bar extending from and attached to each of the vertical side walls of the base member, said support bar being suitably sized and adapted to support the sealed bottom of each of said at least one collecting bag which is in operative association with the downwardly disposed bottom opening of one of the plurality of elongated funnels that is disposed in the second position.

12. The bag loading device of claim 1, wherein the distal end of the at least one elongated funnel has an extended neck with an oblique end cut for ready insertion in to the top entry of the collecting bag.

13. A bag loading device, for use with at least one collecting bag having a top entry and a sealed bottom, comprising:

a. a base member having a frame having a rectangularly shaped bottom wall, two generally vertical side walls, each side wall having its lower edge connected to an opposing side edge of the bottom wall, and a cross bar extending from and attached to each of the vertical side walls and having medial support from at least one vertical post extending upwardly from the bottom wall, said cross bar being suitably sized and adapted to restrict the pivoting movement of the at least one elongated funnel and to engage a collecting bag disposed on the distal end of said at least one elongated funnel;

b. means for pivotally supporting each of said at least one elongated funnel between a first position in which the bottom opening is disposed upwardly relative to the top opening and a second position in which the top opening is disposed upwardly relative to the bottom opening, wherein the included rotational angle between the first position and the second position is approximately 180 degrees, said means for pivotally supporting said at least one elongated funnel being operably connected to said base member, whereby, the top entry of the at least one collecting bag may be operatively placed over the upwardly extending distal end of the at least one funnel, the means for pivotally supporting each of said at least one elongated funnel comprises a first horizontal rod and a second horizontal rod, the first horizontal rod being parallel to the second horizontal rod;

c. at least one elongated funnel having a top opening for loading disposed at a proximate end and a bottom opening for discharging disposed at a distal end, wherein the cross-section of the proximate end of one of the at least one elongated funnel disposed in the second position taken in a horizontal plane forms a rectangle, the at least one elongated funnel comprises a first plurality of elongated funnels arranged side by side longitudinally in a first row along the first horizontal rod and a second plurality of elongated funnels, equal in number and pattern of longitudinal distribution to the first plurality of elongated funnels, arranged side by side in a second row along the second horizontal rod, each horizontal rod being operatively connected to an elongated horizontal eyelet of each of the adjacent plurality of elongated funnels, each of said elongated funnels having a stabilizing lip extending beyond the top opening from the proximate end thereof, the first plurality of elongated funnels being arranged so that the stabilizing lip of each funnel disposed in the second position supports a portion of the upper rim of the top opening of one of the second plurality of elongated funnels that is disposed in a first position along a corresponding portion of the second rod, and the second plurality of elongated funnels being arranged so that the stabilizing lip of each funnel disposed in the second position supports a portion of the upper rim of the top opening of one of the first plurality of elongated funnels that is disposed in a first position along a corresponding portion of the second rod, said distal end having a transverse dimension measured in all directions that is less by a predetermined amount than the smallest transverse dimension of the top entry of the collecting bag, and each of the at least one elongated funnel is independently pivotable; and d. means for carrying the sealed bottom of said at least one collecting bag which is in operative association with the downwardly disposed bottom opening of the at least one elongated funnel that is disposed in the second position, said means for carrying being further attached to and supported by said base member;

whereby:

the at least one elongated funnel may be disposed in the first position in which the bottom opening of the distal end is disposed upwardly relative to the top opening, the top entry of the at least one collecting bag may be placed over the upwardly extending distal end of the at least one funnel, and the at least one funnel with the collecting bag on the distal end may be pivotally rotated from the first position to the second position, thereby positioning the at least one elongated funnel with the top opening upwardly disposed for loading of an article and with the bottom opening of the at least one elongated funnel disposed downwardly for discharging said article into the collecting bag which is supported by the means for carrying.

14. The bag loading device of claim 13, wherein the means for carrying comprises one of an upper surface of the bottom wall of the base member and at least one support bar extending from and attached to each of the vertical side walls of the base member, said support bar being suitably sized and adapted to support the sealed bottom of each of said at least one collecting bag which is in operative association with the downwardly disposed bottom opening of one of the plurality of elongated funnels that is disposed in the second position.

15. The bag loading device of claim 14, wherein the distal end of the at least one elongated funnel has an extended neck with an oblique end cut for ready insertion in to the top entry of the collecting bag.

16. The bag loading device of claim 1, wherein:

a. a frame having a rectangularly shaped bottom wall;

b. the means for pivotally supporting each of said at least one elongated funnel comprises a generally horizontal octagonally shaped rod supported by a plurality of vertical members extending from the rod to the base member;

c. the at least one elongated funnel comprises eight elongated funnels arranged with each funnel pivotally supported by one side of the generally horizontal octagonally shaped rod, the generally horizontal octagonally shaped rod being operatively connected to an elongated horizontal eyelet attached to each of the adjacent plurality of elongated funnels, each of said elongated funnels being arranged so that the upper rim of the top opening of at least one of the funnels disposed in the second position supports a portion of the upper rim of the top opening of the elongated funnel that is disposed in a first position along an opposite segment of the generally horizontal octagonally shaped rod.

17. The bag loading device of claim 16, wherein the cross-section of the proximate end of one of the at least one elongated funnel taken in a horizontal plane forms an isosceles trapezoid.

18. The bag loading device of claim 3, wherein:

a. the base member comprises a frame having a circularly shaped bottom wall and a plurality of vertical radially extending walls extending upwardly from the bottom wall of the frame, said plurality of vertical radially extending walls are radially disposed relative to an axis passing through the center of and perpendicular to the bottom wall;

b. the plurality of elongated funnels comprises eight elongated funnels, each funnel being interpolatively disposed between a pair of the plurality of vertical radially extending walls; and c. the means for pivotally supporting each of said plurality of elongated funnels comprises a first pivot pin and a second pivot pin, each of said first and second pivot pins fastens the funnel to one of the pair of vertical radially extending walls.

19. The bag loading device of claim 18, wherein the bottom of the collecting bag may be supported by one of the bottom wall of the frame and a top surface of a support shelf when said collecting bag is disposed on one of the elongated funnels in a second position in which the top opening is disposed upwardly relative to the bottom opening.

* * * * *